US009709330B2

(12) United States Patent
Anderson et al.

(10) Patent No.: US 9,709,330 B2
(45) Date of Patent: Jul. 18, 2017

(54) DESOLVENTIZER TOASTER

(71) Applicant: Crown Iron Works Company, Roseville, MN (US)

(72) Inventors: George E. Anderson, Champlin, MN (US); Benjamin W. Floan, Andover, MN (US)

(73) Assignee: Crown Iron Works Company, Roseville, MN (US)

( * ) Notice: Subject to any disclaimer, the term of this patent is extended or adjusted under 35 U.S.C. 154(b) by 0 days.

(21) Appl. No.: 14/062,235

(22) Filed: Oct. 24, 2013

(65) Prior Publication Data

US 2014/0115914 A1 May 1, 2014

Related U.S. Application Data

(60) Provisional application No. 61/718,418, filed on Oct. 25, 2012.

(51) Int. Cl.
*F26B 25/00* (2006.01)
*F26B 17/00* (2006.01)

(52) U.S. Cl.
CPC ..... *F26B 25/006* (2013.01); *F26B 17/003* (2013.01)

(58) Field of Classification Search
CPC ..... F26B 13/10; F26B 19/00; F26B 17/003; F26B 21/00; F26B 21/06; F26B 25/006; B01D 47/00; B01D 47/06; C11C 1/00; C11C 1/08
USPC ..... 34/165, 168; 426/601; 554/9, 175, 224
See application file for complete search history.

(56) References Cited

U.S. PATENT DOCUMENTS 2,585,793 A * 2/1952 Kruse ..... A23L 1/2111 34/357
2,806,297 A * 9/1957 Hutchins ..... 34/173
3,018,564 A * 1/1962 Kruse et al. ..... 34/173
3,126,285 A * 3/1964 Lippold ..... 426/459
3,359,644 A * 12/1967 Goldman ..... 34/58
3,367,034 A * 2/1968 Good ..... A23L 1/0151 219/629
3,392,455 A * 7/1968 Kingsbaker, Jr ..... A23J 1/006 159/17.3

(Continued)

FOREIGN PATENT DOCUMENTS

CN 203319972 U 12/2013
EP 1336426 A1 8/2003

(Continued)

OTHER PUBLICATIONS

Solvent Extraction Techniques for Soybeans and Other Seeds: Desolventizing and Toasting by C.L. Kingsbasker et al. J. A,. Oil Chemists' Soc., Oct. 1970 (vol. 47).*

(Continued)

*Primary Examiner* — Steve M Gravini
(74) *Attorney, Agent, or Firm* — Fredrikson & Byron, P.A.

(57) ABSTRACT

An improved desolventizer toaster. The invention includes a housing. Within the housing, a first set of trays and a second set of trays are mounted. The first trays and second trays are disposed such that they are generally vertically spaced from one another and in a generally parallel disposition with respect to each other. Means for mixing vapors are provided, and they are positioned in a vapor mixing zone which is intermediate the first set of trays and second set of trays.

8 Claims, 3 Drawing Sheets

(56) References Cited

U.S. PATENT DOCUMENTS

| | | | | |
|---|---|---|---|---|
| 3,942,960 | A * | 3/1976 | Girard | 95/119 |
| 4,153,787 | A * | 5/1979 | Cheape et al. | 528/500 |
| 4,622,760 | A * | 11/1986 | Schumacher | 34/65 |
| 4,635,380 | A * | 1/1987 | Anderson | 34/468 |
| 6,279,250 | B1 * | 8/2001 | Anderson | F26B 3/00 34/164 |
| 6,766,595 | B2 * | 7/2004 | Anderson | 34/526 |
| 6,996,917 | B2 * | 2/2006 | Anderson | A23L 1/0151 34/165 |
| 7,169,432 | B2 * | 1/2007 | Tanaka | A23L 1/164 426/466 |
| 8,720,082 | B2 * | 5/2014 | Kemper et al. | 34/527 |
| 2002/0066663 | A1 | 6/2002 | Anderson | |
| 2008/0115309 | A1 * | 5/2008 | Pan et al. | 15/300.1 |
| 2012/0266489 | A1 * | 10/2012 | Anderson et al. | 34/588 |
| 2014/0115914 | A1 * | 5/2014 | Anderson et al. | 34/168 |

FOREIGN PATENT DOCUMENTS

| | | | |
|---|---|---|---|
| EP | 2725315 | A2 * | 4/2014 |
| WO | WO 2007038503 | A2 * | 4/2007 |

OTHER PUBLICATIONS

Desolventizer Toaster brochure dated May 2007.*
Jalal, Rashwan, Extended European Search Report under Rule 62 EPC for EP Appl. No. 13190244.7, Aug. 6, 2015.

* cited by examiner

DESOLVENTIZER TOASTER

CROSS-REFERENCE TO RELATED APPLICATIONS

This is a regular application filed under 35 U.S.C. §111(a) claiming priority, under 35 U.S.C. §119(e)(1), of provisional application Ser. No. 61/718,418, previously filed Oct. 25, 2012 under 35 U.S.C. §111(b).

TECHNICAL FIELD

The present invention deals broadly with equipments for processing commodities such as granular products having a solvent entrained therein. The processing effects desolventization of a granular product or meal. The invention is particularly applicable for processing agricultural products which have been processed using solvents such hexane. The agricultural product can be desolventized to make it consumable. Concurrently, the solvent, if it is desired, can be recovered. The invention facilitates mixing of heavy vapor passing downwardly in the equipment with lower density vapor passing upwardly.

BACKGROUND OF THE INVENTION

The desolventizer toaster (DT) is an equipment which has been utilized in a number of contexts over the years. It is particularly applicable for processing agricultural commodities. There are a number of advantages which can be obtained by processing granular material or meal in a manner known in the prior art.

Nevertheless, there are shortcomings inherent in the manner in which processing is conducted in the prior art. A DT known in the art employs a plurality of generally parallel, vertically spaced trays mounted within a housing. The material to be processed is contacted with water or steam, or a mixture of the two, which is introduced into the equipment housing at the bottom of the DT. Moisture is thereby afforded to form an azeotrope in the upper trays and to avoid excessive drying of the product. Meal passes downwardly through each tray by transiting through an open hole through which passage is controlled by a gate mechanism. During the processing, solvent heavy vapors are removed from the material being processed. Because various solvents, including hexane, have a density significantly in excess of the density of steam, there is a tendency for the almost pure solvent to boil off at the top of the trays in the upper section and cascade into the lower trays. Such a consequence can lead to contamination of the nearly pure steam environment in the lower section of the DT. The desolventizing which has progressed to a desired point can, as a result, be negated.

It is to these shortcomings and deficiencies of the prior art that the present invention is directed. It is an improved structure which serves to solve problems existent with equipments known in the prior art.

SUMMARY OF THE INVENTION

The present invention is an improved desolventizer toaster (DT). The DT is defined by a housing which provides therewithin a restriction which creates a mixing zone. Light density vapor from the lower part of the equipment is volitionally mixed in the mixing zone with high density solvent vapor passing downwardly from the upper part of the equipment. The turbulent mixing zone forces higher vapor velocity, in one embodiment, along the inner side of the DT wall. A consequence of such mixing is that heavy vapors will not flow from the top to the bottom of the DT and thereby contaminate the lower vapors in the meal.

Various alternative constructions creating the restriction and mixing zone are envisioned. While FIG. 1 shows a planar baffle, an alternative to a planar baffle is illustrated in FIG. 2. FIG. 2 illustrates arcuate vanes for redirecting heavy vapors in a desired direction.

Shown in FIG. 1 also is an annular steam pipe for injecting steam in low velocity regions. Such an embodiment is also specifically envisioned in this invention.

The present invention is thus an improved desolventizer toaster. More specific features and advantages obtained in view of those features will be able to be understood with reference to the Detailed Description, claims and drawing figures.

DETAILED DESCRIPTION OF THE INVENTION

Figure 1:
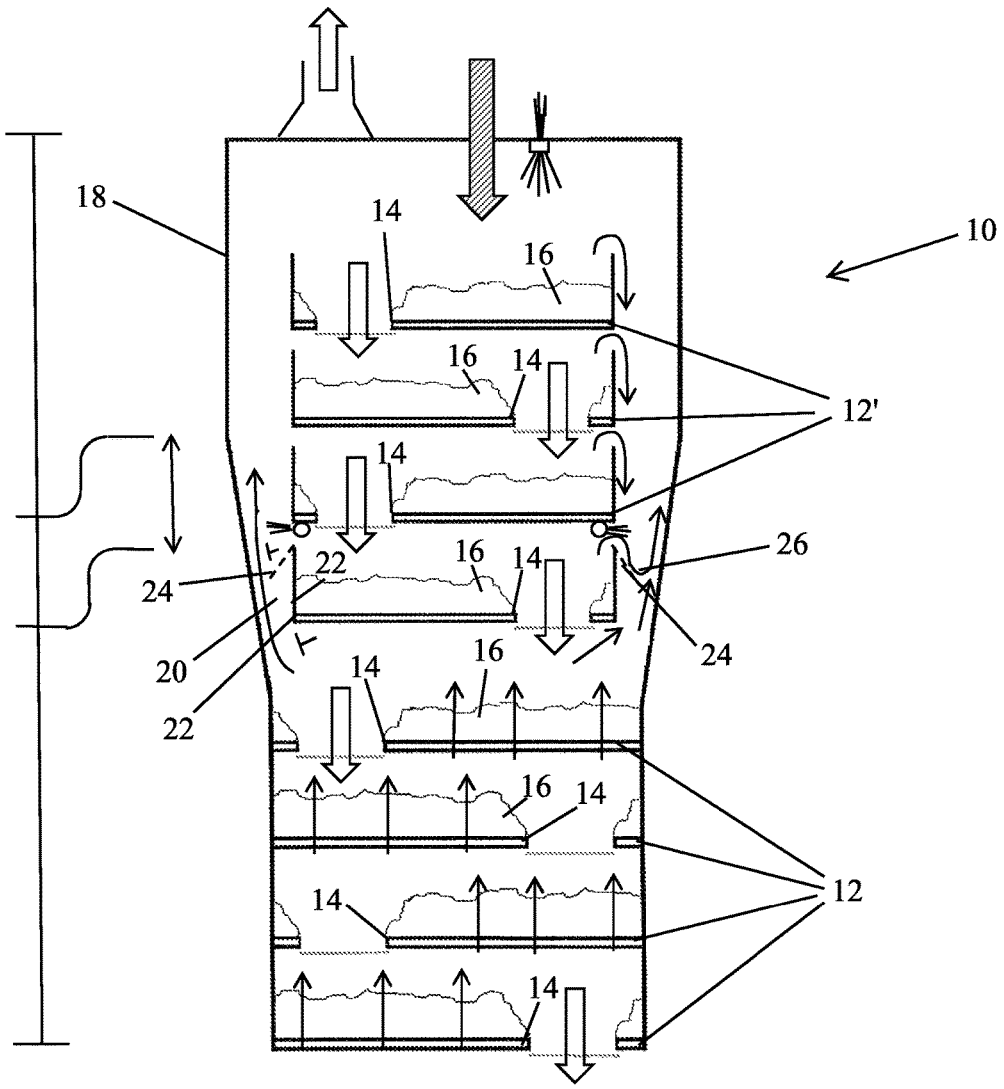
FIG. 1 is a side elevational view of a DT employing the present invention.
Figure 2:
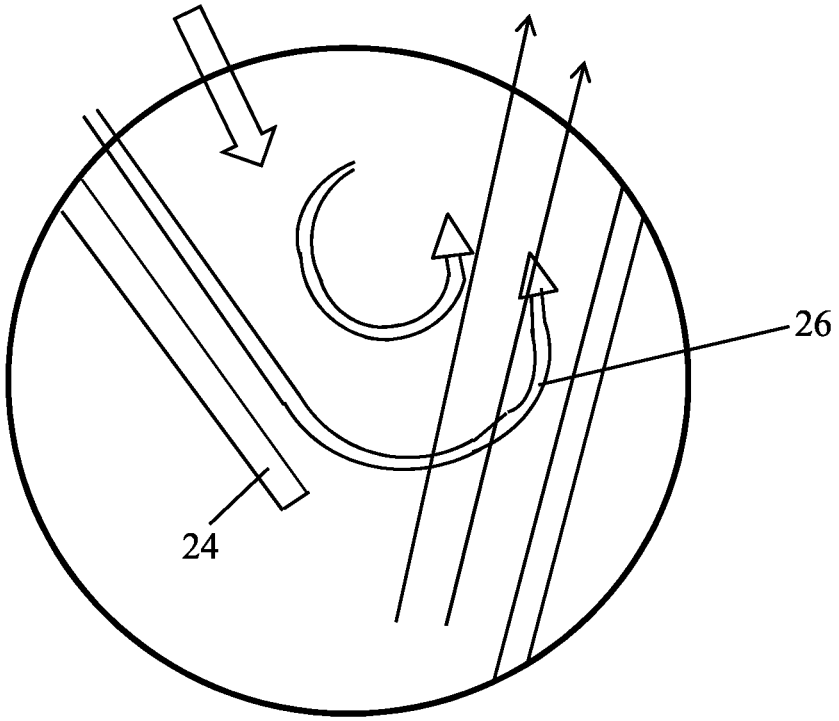
FIG. 2 is an enlarged view of a portion circled in FIG. 1.
Figure 3:
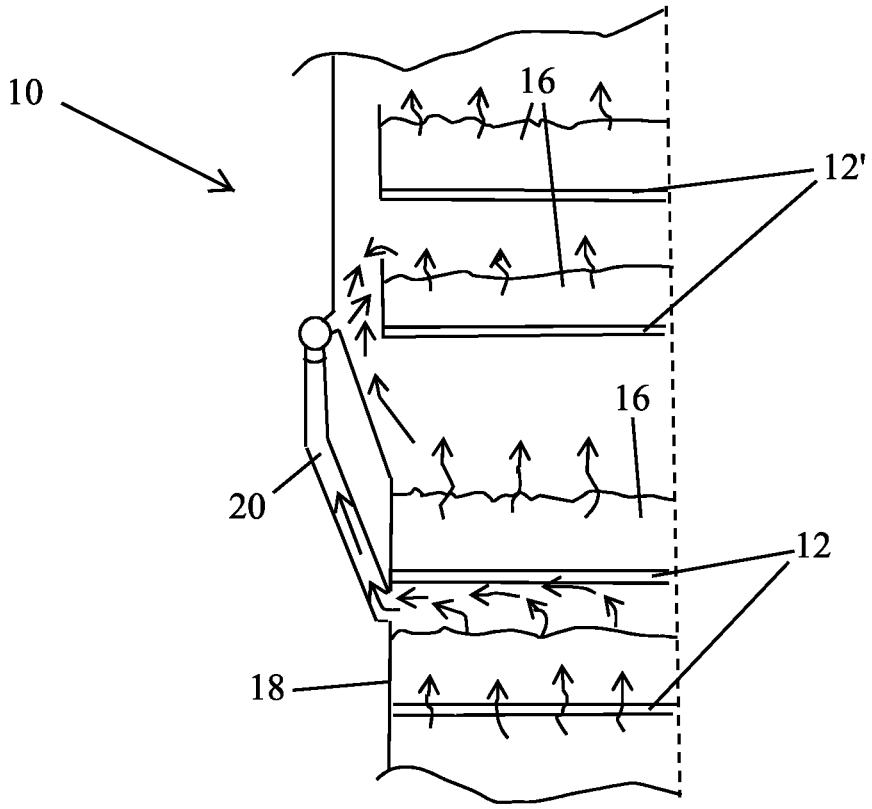
FIG. 3 is a side elevational view of a portion of a DT illustrating another embodiment of the present invention.

Referring now to the drawing figures, wherein like reference numerals denote like elements throughout the several views, FIG. 1 illustrates a first configuration of the present invention. The embodiment illustrated, however, in itself, illustrates a number of different configurations of the invention.

Illustrated is a DT housing 10 which encloses a plurality of generally circular trays 12, 12'. The trays 12, 12' are characterized either as one of a first set of trays, which are the lower four trays in FIG. 1, or one of a second set of trays, which are the upper four trays. The trays 12, 12' are substantially coaxial, spaced vertically, and parallel to each other. The figure shows the trays, however, as having egress ports 14, through which an agricultural product (such as a meal 16) being processed, alternate on sides of a central axis of the housing 10. The product, or meal 16, then is spread over a particular tray and is intended to pass downwardly through the ports. Such movement of the meal 16 can be facilitated by use of wiping arms (not shown) which move the meal 16 across the surface of a corresponding tray.

FIG. 1 shows the wall 18 of the housing 10 proximate the upper tray set (that is, the second tray set) as having a greater diameter than the first tray set. Consequently, the diameter of the first tray set can be made to closely approximate the diameter of the housing 10 at the location occupied by the first tray set. As will be able to be seen in view of this disclosure, a generally conical vapor mix zone 20 of the housing 10 defines an annular restriction 22 within which mixing of denser fluid passing downwardly through the zone 20 will engage and mix with less dense fluid passing upwardly through the zone 20. The vapor mix zone is specifically designed as having a restricted area for flow of light density vapor from the lower part of the machine up into the upper part where much of the very high density solvent vapor is present.

The scientific principle observed here is that the velocity of vapors rising through the restriction tends to both mix with the falling heavy vapor so that it loses its high density and becomes a moderate density mix of steam and solvent. Additionally, the velocity of the fluid develops a slight pressure drop. This pressure drop will tend to retard the fall of heavy fluid until the mixing occurs just above the mixing zone 20. It will be understood that the wall 18 of the housing, at the mixing zone 20, is intentionally conical in shape to define the mixing zone 20. It will further be understood, however, that other restrictions defining a mixing zone can be employed. For example, an annular baffle 24, generally conical in shape may be employed to define a restriction and a mixing zone. Such a baffle is illustrated in phantom line in FIG. 1. It will be understood that it is possible to employ both the conical baffle 24 and the conical portion 20 of the housing wall 22 to jointly define the restriction and the mixing zone 20 thereby. Such a restriction, again, is intentional to obtain the mixing function. The mixing function, in accordance with the present invention, is far greater than that which exists in a traditional DT system. For most applications, the restricted flow velocity is calculated so as to be sufficient to cause turbulent flow. Absent a construction wherein a restriction is defined, the heavy solvent mass will often fall down into lower portions of the housing 10, go down with the meal being treated, and will cause high loss of solvent in the meal at the discharge from the housing 10.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A desolventizer toaster (DT) comprising:

a housing containing a plurality of generally parallel, vertically spaced trays therewithin, a first set of the plurality of trays each having a peripheral edge engaging an inner surface of a wall defining the housing, and a second set of the plurality of trays each having an edge, generally concentric to, and spaced inwardly from said inner surface of said wall defining the housing, an annular baffle positioned inside of the housing and being configured to restrict fluid passage between the inner surface of the wall defining the housing and the edge of the trays in the second set of trays, thereby causing lower density fluid passing upwardly from said first set of trays and higher density fluid passing downwardly from said second set of trays to intermix.

2. The desolventizer toaster in accordance with claim 1, wherein said wall defining said housing includes an axially extending annular zone which is generally conical in shape.

3. The desolventizer toaster in accordance with claim 2, wherein the annular baffle extends radially outwardly from a lowermost of said second trays within said annular zone.

4. The desolventizer toaster in accordance with claim 3 further comprising an annular tube manifold having a multiplicity of circumferentially spaced orifices directing steam radially outwardly to facilitate mixing of vapors.

5. A desolventizer toaster, comprising:

(a) a housing;

(b) a first set of trays mounted within said housing, said first trays being disposed generally vertically spaced and parallel to each other and having peripheral edges engaging an inner surface of a wall defining the housing;

(c) a second set of trays mounted within said housing, said second trays being disposed generally vertically spaced and parallel to each other and to said first set of trays, said second set of trays each having an edge spaced inwardly from said inner surface; and (d) means for mixing vapors in a vapor mixing zone located between said first set of trays and said second set of trays.

6. A desolventizer toaster in accordance with claim 5 wherein said means for mixing vapors comprises an annular tube manifold having a multiplicity of circumferentially spaced orifices directing steam radially outwardly to facilitate mixing of vapors.

7. A desolventizer in accordance with claim 5 wherein said means for mixing vapors comprises a plurality of axially extending small ducts running external to said housing between said first set of trays and said second set of trays.

8. A desolventizer in accordance with claim 5 wherein said means for mixing vapors comprises an internal baffle.

* * * * *